United States Patent [19]

Meyers

[11] Patent Number: 4,550,430

[45] Date of Patent: Oct. 29, 1985

[54] SOUND REPRODUCING SYSTEM UTILIZING MOTIONAL FEEDBACK AND AN IMPROVED INTEGRATED MAGNETIC STRUCTURE

[76] Inventor: Stanley T. Meyers, 122 N. Riverside Ave., Red Bank, N.J. 07701

[21] Appl. No.: 236,276

[22] Filed: Feb. 20, 1981

[51] Int. Cl.[4] ..... H04R 3/08; H04R 9/06

[52] U.S. Cl. ..... 381/96; 179/115.5 R

[58] Field of Search ..... 179/1 F, 115.5 R, 115.5 DV, 179/115.5 VC, 115.5 SF; 381/96

[56] References Cited

U.S. PATENT DOCUMENTS

| | | | |
|---|---|---|---|
| 1,783,569 | 12/1930 | Hanna | 179/115.5 R |
| 2,897,291 | 7/1959 | Burke | 179/115.5 DV |
| 3,073,899 | 1/1963 | Farnsworth, III | 179/1 F |
| 3,530,244 | 9/1970 | Reiffin | 179/1 F |
| 3,798,374 | 3/1974 | Meyers | 179/1 F |
| 3,821,473 | 6/1974 | Mullins | 179/1 F |
| 3,878,748 | 4/1975 | Spence | 179/1 F X |
| 4,025,722 | 5/1977 | Karron | 179/1 F X |
| 4,256,923 | 3/1981 | Meyers | 179/1 F |

FOREIGN PATENT DOCUMENTS

| | | | |
|---|---|---|---|
| 2604888 | 8/1976 | Fed. Rep. of Germany | 179/1 F |

OTHER PUBLICATIONS

"North American Philips Publication;" Undated Trade Circular Distributed by North American Philips Corp.

*Primary Examiner*—Keith E. George

*Attorney, Agent, or Firm*—R. Martin Oliveras

[57] ABSTRACT

A sound reproducing system utilizes motional feedback and an improved integrated magnetic structure for reducing loudspeaker distortion; for reducing acoustic coupling between the radiated sound energy output and the cone motion sensing structure thereby reducing unwanted feedback signals; and for reducing obstruction of the radiated sound energy output by the cone motion sensing structure thereby minimizing undesirable alteration of the radiated tonal quality. The loudspeaker includes a cone, a frame, and flexible webs. The main electromagnetic structure includes a rear cylindrical iron pole piece, an annular cylindrical permanent magnet, an inner annular cylindrical iron pole piece, a main voice coil bobbin, a main voice coil, and a front annular cylindrical iron pole piece. The cone motion sensing structure includes a front annular copper disc, a rear cylindrical non-magnetic support member, an annular cylindrical copper sleeve, a cylindrical iron rod, a feedback sensing coil, a feedback sensing coil bobbin, and a feedback sensing coil bobbin support member. The associated circuitry includes a stability control network, a velocity equalizer, and a frequency equalizer. A feature of the present invention is that: the cone motion sensing structure utilizes the stray magnetic field of the main electromagnetic structure to provide the motional feedback signal which is functionally related to axial cone velocity, which motional feedback signal is fed to the stability control network. An advantage of the present invention is that it allows use of smaller loudspeakers and smaller loudspeaker enclosures.

11 Claims, 2 Drawing Figures

SOUND REPRODUCING SYSTEM UTILIZING MOTIONAL FEEDBACK AND AN IMPROVED INTEGRATED MAGNETIC STRUCTURE

FIELD OF THE INVENTION

This invention relates to sound reproducing systems and in particular to such systems which include the loudspeaker in a feedback path.

CROSS-REFERENCE TO RELATED APPLICATIONS

This application is related to prior copending applications Ser. No. 067,515 entitled "Sound Reproducing System Utilizing Motional Feedback and Velocity-Frequency Equalization", now U.S. Pat. No. 4,276,443; and Ser. No. 067,516 entitled "Sound Reproducing System Utilizing Motional Feedback And Integrated Magnetic Structure", now U.S. Pat. No. 4,256,923, both issued to applicant herein.

BACKGROUND OF THE INVENTION

Several prior art sound reproducing systems have included the loudspeaker in a feedback for reducing loudpeaker distortion, and for allowing use of smaller loudspeakers and smaller loudspeaker enclosures. Such prior art systems, especially those which include means for magnetically sensing the axial motion of the associated loudspeaker cone, have considered neither the detrimental effects due to electrical interference from the main electromagnetic loudspeaker structure, nor the proper frequency shaping of the motional feedback signal to cause the loudspeaker to respond linearly to the input source signal. Such prior art sound reproducing systems are cited in U.S. Pat. No. 3,798,374 entitled "Sound Reproducing System Utilizing Motional Feedback", issued on 3/19/74 to Applicant herein.

Further, U.S. Pat. No. 3,821,473, entitled "Sound Reproduction With Driven and Undriven Speakers And Motional Feedback", issued on 6/28/74 to Mullins, discloses amplifier 4, device 12, and speakers 14 and 16. In such system there is included an undriven speaker and each of the speakers mounted in the enclosure have different resonant frequencies and different motional devices attached thereto. The outputs of the motional feedback devices are combined to provide a negative feedback signal to the amplifier. The system also includes motional sensor 18. Such sound reproduction system relates to combined motional feedback control of a driving and a driven speaker in a single enclosure. There does not appear to be a description of any particular type of motional feedback sensing means although acceleration sensing is mentioned.

U.S. Pat. No. 3,878,748, entitled "Oral Cavity Controlled Electronic Musical Instrument", issued on 4/22/75 to Spence, discloses sensor coil 58. FIG. 9 of such patent refers to a method of divesting a separate sensing coil of interference from the voice coil. Such arrangement appears to be a ramification of bridge type feedback control.

U.S. Pat. No. 4,025,722, entitled "Method And Apparatus For Recording", issued on 5/24/77 to Karron, discloses speaker 20 including voice coil 18 and auxiliary winding 30. The output of auxiliary winding 30 is coupled to primary winding 32 of transformer 34, but does not appear to be fed back to amplifier 16.

The North American Philips Corporation distributes a sound reproducing system including a signal source, an electronic cross-over, a comparator, a low frequency amplifier, a woofer, a piezoelectric sensor, a high frequency amplifier, a second crossover, a midrange speaker, and a tweeter speaker. In such sound reproducing system, acceleration feedback is utilized but only in the so-called woofer speaker.

However, none of the aforementioned prior art sound reproducing systems includes the particular cone motion sensing structure of the present invention to produce a motional feedback signal and utilize such motional feedback system as herein described.

Objects of the present invention are therefor to:

- utilize motional feedback in a sound reproducing system for reducing loudspeaker distortion, for providing a uniform sound energy output, and for effecting linear loudspeaker response to the input source signal;
- utilize motional feedback in a sound reproducing system wherein relatively small loudspeakers and relatively small loudspeaker enclosures are required;
- utilize the stray magnetic field of the loudspeaker's main electromagnetic structure to provide a motional feedback signal readout of the loudspeaker cone;
- reduce acoustic coupling between the sound energy output and the cone motion sensing structure; and
- reduce obstruction of the sound energy output by the cone motion sensing structure.

SUMMARY OF THE INVENTION

According to the present invention, a sound reproducing system utilizes motional feedback and an improved integrated magnetic structure for reducing loudspeaker distortion; for reducing acoustic coupling between the radiated sound energy output and the cone motion sensing structure thereby reducing unwanted feedback signals; and for reducing obstruction of the radiated sound energy output by the cone motion structure thereby minimizing alteration of the radiated tonal quality. The loudspeaker includes a cone, a frame, and flexible webs. The main electromagnetic structure includes a rear cylindrical iron pole piece, an annular cylindrical permanent magnet, an inner annular cylindrical iron pole piece, a main voice coil bobbin, a main voice coil, and a front annular cylindrical iron pole piece. The cone motion sensing structure includes a front annular copper disc, a rear cylindrical non-magnetic support member, an annular cylindrical copper sleeve, a cylindrical iron rod, a feedback sensing coil, a feedback sensing coil bobbin, and a feedback sensing coil bobbin support member. The associated circuitry includes a stability control network, a velocity equalizer, and a frequency equalizer.

Features of the present invention are therefor that:

- the motional feedback signal generated by the cone motion sensing structure is functionally related to axial cone velocity;
- the cone motion sensing structure utilizes the stray magnetic field of the main electromagnetic structure to provide such motional feedback signal;
- the motional feedback signal from the cone motion sensing structure is substantially free from components due to current in the loudspeaker voice coil whereby the motional feedback signal is a function of cone motion only; and
- the cone motion sensing structure is rearwardly recessed from the loudspeaker cone such that acoustic coupling between the sound energy output and the cone motion sensing structure is reduced and obstruction of the sound energy output by the cone motion sensing structure is eliminated to improve the natural quality of the radiated sound energy output.

Advantages of the present invention are therefor that:

relatively small loudspeakers and relatively small loudspeaker enclosures can be utilized;

loudspeaker diaphragm performance is substantially independent of enclosure characteristics; and a separate electromagnetic structure is not required for the functioning of the cone motion sensing structure.

DESCRIPTION OF THE DRAWING

The above and other objects, features, and advantages of the present invention will be better appreciated by consideration of the following detailed description and the drawing in which.

DETAILED DESCRIPTION

Figure 1:
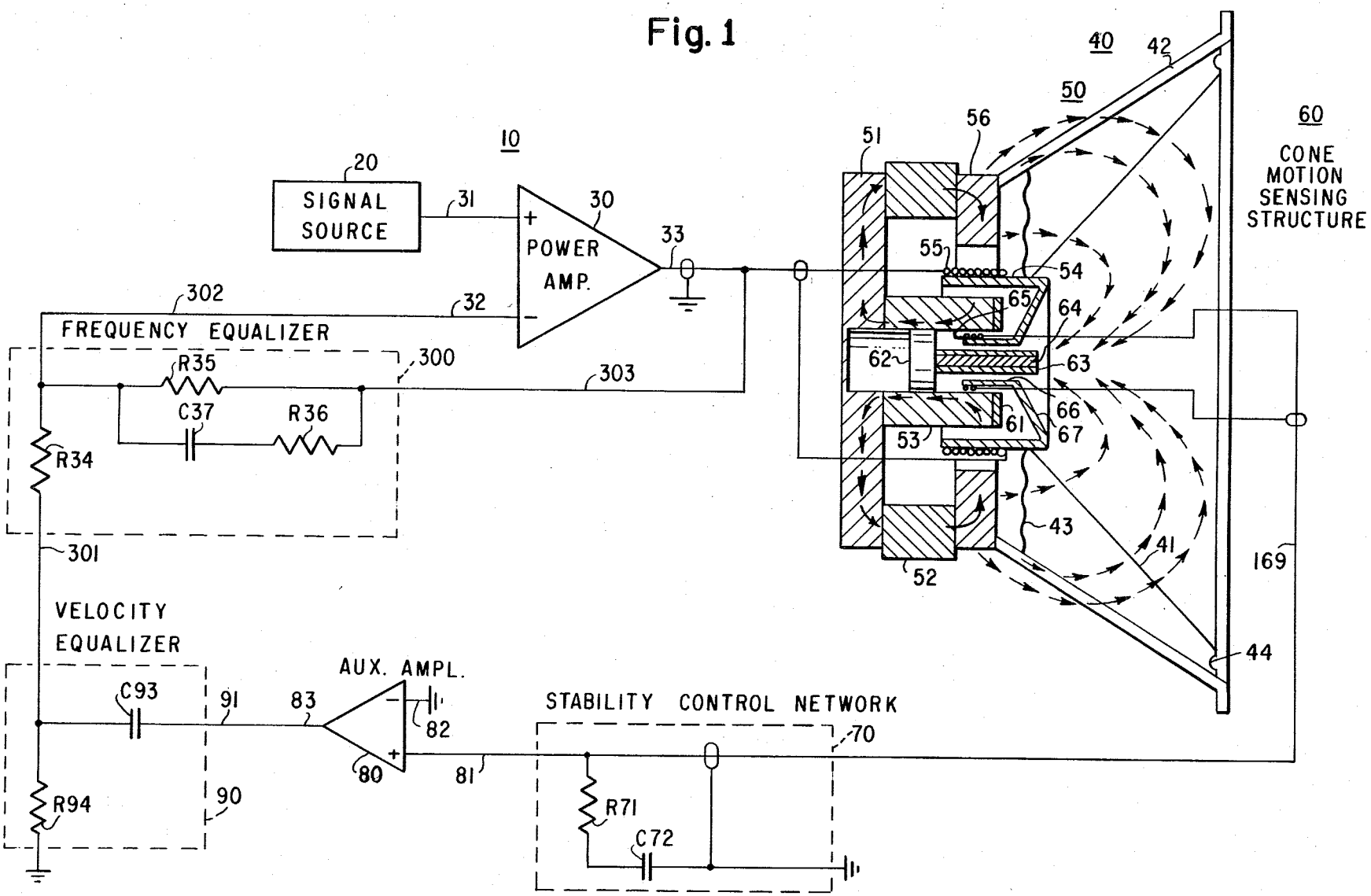
FIG. 1 illustrates a sound reproducing system utilizing motional feedback and an improved integrated magnetic structure according to the present invention.

FIG. 1 illustrates sound reproducing system 10 utilizing motional feedback and an improved integrated magnetic structure and generally comprising frequency equalized power amplifier 30 which is jointly responsive to input signal source 20 and to velocity equalizer 90; moving coil type loudspeaker structure 40 which is responsive to frequency equalized power amplifier 30; stability control network 70 which is responsive to loudspeaker structure 40; auxiliary amplifier 80 which is responsive to stability control network 70; and aforementioned velocity equalizer 90 which is responsive to auxiliary amplifier 80. Frequency equalized power amplifier 30 and velocity equalizer 90 of system 10 are disclosed and claimed in said prior copending application Ser. No. 067,515, now U.S. Pat. No. 4,276,443, while stability control network 70 of system 10 is disclosed and claimed in said prior copending application Ser. No. 067,516, now U.S. Pat. No. 4,256,923.

Loudspeaker structure 40 includes cone 41, frame or basket 42, webs 43 and 44, and further comprises main electromagnetic structure 50 and cone motion sensing structure 60. Main electromagnetic structure 50 includes rear cylindrical iron pole piece 51, annular cylindrical permanent magnet 52, inner annular cylindrical iron pole piece 53, thin main voice coil bobbin 54, main voice coil 55, and front annular cylindrical iron pole piece 56. Cone motion sensing structure 60 includes front annular copper disc or plate 61, rear cylindrical non-magnetic support member 62, annular cylindrical copper sleeve 63, solid cylindircal iron rod 64, feedback sensing coil 65, feedback sensing coil bobbin 66, and feedback sensing coil bobbin conical support member 67.

The operation of main electromagnetic structure 50 and the dimensions, shapes, and configurations of its elements are well known in the art and accordingly shall not be described in detail herein.

Cone motion sensing structure 60 derives its own magnetic field from the stray magnetic field emanating from main electromagnetic structure 50 to provide the feedback signal to stability control network 70, which motional feedback signal is functionally related to the axial velocity of cone 41. The motion of cone 41 is sensed by connecting the front end of feedback sensing coil bobbin 66 to the front end of main voice coil bobbin 54 via conical support member 67. From FIG. 1 it is apparent that: the inner diameter of main voice coil bobbin 54 is greater than the outer diameter of inner pole piece 53; the inner diameter of inner pole piece 53 is greater than the outer diameter of feedback bobbin 66; the inner diameter of feedback bobbin 66 is greater than the outer diameter of copper sleeve 63; the inner diameter of copper sleeve 63 is approximately equal to and slightly greater than the diameter of iron rod 64. It is also apparent from FIG. 1 that the inner diameter of inner pole piece 53 is approximately equal to and slightly greater than the diameter of suppport member 62. Further, main voice coil 55 is attached to the radially outward surface of main voice coil bobbin 54 while feedback sensing coil 65 is attached to the radially outward surface of feedback sensing coil bobbin 66. Accordingly, main voice coil 55 moves axially along the annular cylindrical gap formed between the inner diameter of front pole piece 56 and the outer diameter of inner pole piece 53 while feedback sensing coil 65 moves axially along the annular cylindrical gap formed by the inner diameter of inner pole piece 53 and the outer diameter of copper sleeve 63.

The primary magnetic path includes permanent magnet 52, front pole piece 56, main voice coil 55, inner pole piece 53, rear pole piece 51, and again magnet 52. The secondary magnetic path includes permanent magnet 52, front pole piece 56, iron rod 64, copper sleeve 63, feedback sensing coil 65, inner pole piece 53, rear pole piece 51, and again permanent magnet 52.

The function of support member 62 is to connect iron rod 64 and copper sleeve 63 at their respective rearward ends to the inner diameter of inner pole piece 53. The front surface of rear pole piece 51 is connected to the rear surfaces of permanent magnet 52 and inner pole piece 53 while the front surface of permanent magnet 52 is connected to the rear surface of front pole piece 56. Finally, copper disc 61 is connected to the front surface of inner pole piece 53. The placement, attachment, connection, and choice of materials for the above elements can be done utilizing known methods in the art and to suit individual applications. Further, disc or plate 61 and sleeve 63 can be made from any non magnetic electrically conducting metallic material such as aluminum or copper to minimize leakage interference.

The stray magnetic field emanating from main electromagnetic structure 50 is shown in FIG. 1 by way of dashed arrows emanating in a clockwise direction from the upper portion of front pole piece 56 and in a counterclockwise direction from the lower portion of front pole piece 56. Accordingly, main voice coil 55 moves axially along its respective annular cylindrical gap and traverses the primary magnetic path while feedback coil 65 moves axially along its respective annular cylindrical gap and traverses the secondary magnetic path effected by the stray magnetic field and the copper shielding provided by copper sleeve 63 and disc 61.

Accordingly, axial motion of feedback bobbin 66 and feedback coil 65 along their respective annular cylindrical gap causes a voltage to be induced in sensing coil 65 as sensing coil 65 cuts the flux lines of the secondary magnetic path located within such gap. The voltage induced in sensing coil 65 is functionally related to the axial velocity of sensing coil 65, and thus the axial velocity of feedback bobbin 66, conical support member 67, main voice coil bobbin 54, and cone 41 which is attached to the front end of main voice coil bobbin 54.

Iron rod 64 collects and concentrates the stray magnetic field in its vicinity and converts it to a uniform magnetic field in the annular cylindrical gap associated with feedback sensing coil 65 and the secondary magnetic path. The electrical conductivity of copper disc 61 and copper sleeve 63 causes the production of internal eddy currents which tend to counteract and substantially compensate for interfering electrical fields or variable magnetic fields produced by main electromagnetic structure 50. The radial dimensions of the respective annular cylindrical gaps associated with main voice coil 55 and feedback sensing coil 65 are made as small as possible without interfering with axial cone motion in order to produce the strongest and most uniform magnetic flux within such gaps.

It is apparent from FIG. 1 that the components of cone motion sensing structure 60 are substantially located to the rear of and radially inward from the rear end of cone 41. This of course results in a reduction of any acoustic coupling between the sound energy output of cone 41 and cone motion sensing structure 60. In addition, the placement of cone motion sensing structure 60 is such that obstruction of the sound energy output of cone 41 is also reduced. This is, in part, effected by placing the front surfaces of front pole piece 56 and copper disc 61 at approximately the same axial location. Further, feedback sensing coil 65 is also placed at approximately the same axial location as main voice coil 55. The projection of iron rod 64 into the sound field should be no greater than necessary to pick up sufficient stray magnetic field to provide adequate sensing gap flux.

Figure 2:
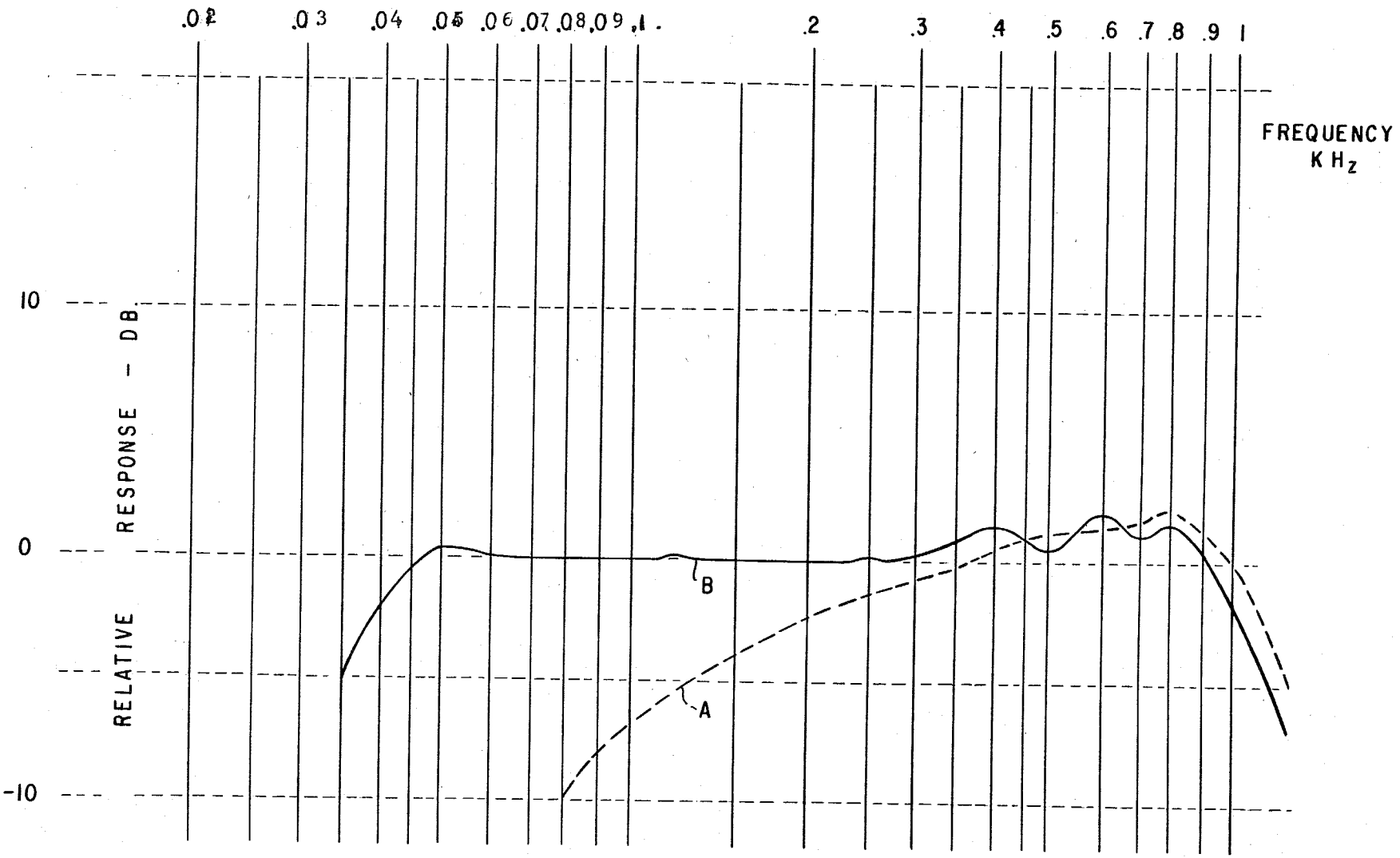
FIG. 2 illustrates sound energy output curves characteristic of the prior art and of the present invention.

FIG. 2 illustrates sound energy output curves characteristic of the prior art and of the present invention. Curve A is the sound energy output in relative dB response as a function of frequency for a loudspeaker without motional feedback or an improved integrated magnetic structure of the present invention while curve B is the sound energy output as a function of frequency for the same loudspeaker including motional feedback and an integrated magnetic structure according to the present invention in the frequency range where this particular loudspeaker cone acts substantially as a rigid member. It is apparent that curve B reflects a uniform sound energy output over the frequency range of interest. The loudspeaker tested herein is a four inch loudspeaker located within a one quarter cubic foot enclosure.

It will apparent to those skilled in the art that configurations as shown in FIGS. 7A, 7B, and 7C of previous Meyers U.S. Pat. No. 3,798,374 can be had using sound reproducing system 10 herein. It will also be apparent that smaller acoustic enclosures can be utilized based of the above.

While the arrangement according to the present invention has been described in terms of a specific embodiment, it will be apparent to those skilled in the art that many modifications are possible within the spirit and scope of the disclosed principle.

What is claimed is:

1. In combination with a loudspeaker comprising a main electromagnetic structure and a sound producing member being driven by said main electromagnetic structure, said main electromagnetic structure exhibiting a stray magnetic field, sound producing member motion sensing means comrpising:

an iron member being responsive to said stray magnetic field for forming a magnetic field path to and from said main electromagnetic structure;

a first non-magnetic electrically conductive member surrounding said iron member; and feedback means being attached to said sound producing member and moving uniformly therewith for sensing the motion of said sound producing member;

wherein said main electromagnetic structure further comrpises an inner pole piece surrounding said first non-magnetic electrically conductive member; said inner pole piece and said first non-magnetic electrically conductive member forming a gap thereinbetween; and said magnetic field path traversing or being located along said main electromagnetic structure, said iron member, said first non-magnetic electrically conductive member, said gap, said feedback means, said gap, said inner pole piece, and the rest of said main electromagnetic structure.

2. The motion sensing means of claim 1 wherein said first non-magnetic electrically conductive member is made of copper.

3. The motion sensing means of claim 1 wherein said first non-magnetic electrically conductive member is made of aluminum.

4. The motion sensing means of claim 1 wherein said main electromagnetic structure further comprises a second non magnetic electrically conductive member being interposed in between said inner pole piece and said stray magnetic field.

5. The motion sensing means of claim 4 wherein said second non-magnetic electrically conductive member is made of copper.

6. The motion sensing means of claim 4 wherein said second non-magnetic electrically conductive member is made of aluminum.

7. In a loudspeaker structure, the combination comprising:

a main electromagnetic structure exhibiting a stray magnetic field and further comprising a sound producing member and an inner pole piece having an inner diameter; and means for sensing the motion of said sound producing member comprising:

an iron member being located radially inward relative to said inner pole piece inner diameter, said iron member being responsive to said stray magnetic field for forming a magnetic field path to and from said main electromagnetic structure; and feedback means being fixedly attached to said sound producing member and moving uniformly therewith and being located in between said inner pole piece inner diameter and said iron member for sensing the motion of said sound producing member;

wherein said motion sensing means further comprises a non-magnetic electrically conductive member being located in between said feedback means and said iron member.

8. In a loudspeaker structure, the combination comprising:

a main electromagnetic structure exhibiting a stray magnetic field and further comprising a sound producing member and an inner pole piece having an inner diameter; and means for sensing the motion of said sound producing member comprising:

an iron member being located radially inward relative to said inner pole piece inner diameter, said iron member being responsive to said stray magnetic field for forming a magnetic field path to and from said main electromagnetic structure; and feedback means being fixedly attached to said sound producing member and moving uniformly therewith and being located in between said inner pole piece inner diameter and said iron member for sensing the motion of said sound producing member wherein said main electromagnetic structure further comprises a non-magnetic electrically conductive member being interposed in between said inner pole piece and said stray magnetic field.

9. In a loudspeaker structure, the combination comprising:

a main electromagnetic structure exhibiting a stray magnetic field and further comprising an inner pole piece and a sound producing member being driven axially by and being responsive to said main electromagnetic structure; and means for sensing the axial motion of said sound producing member comprising:

a solid axially directed iron member being fixedly attached relative to said inner pole piece;

an annular axially directed cylindrical copper member being concentric with and surrounding said iron member and wherein an annular axially directed gap is formed in between said inner pole piece and said annular copper member, and whereby a magnetic field path derived fom said stray magnetic field results, said magnetic field path traversing or being located along said inner pole piece, said gap, said annular copper member, said iron member, and the remainder of said main electromagnetic structure; and feedback means being fixedly attached to said sound producing member and being located along and within said gap and interacting with said derived magnetic field path for producing an electrical signal which is functionally related to the axial velocity of said sound producing member.

10. The loudspeaker structure of claim 9 wherein said main electromagnetic structure further comprises a copper disc being interposed in between said inner pole piece and said stray magnetic field.

11. In combination with a loudspeaker comprising a main electromagnetic structure and a sound producing member being driven by said main electromagnetic structure, said main electromagnetic structure exhibiting a stray magnetic field, sound producing member motion sensing means comprising:

a metallic member being responsive to said stray magnetic field for collecting, concentrating, and forming a magnetic field path to and from said main electromagnetic structure;

a non-magnetic electrically conductive member, said non-magnetic electrically conductive member being located along said magnetic field path for suppressing any variable components derived in said magnetic field path from said stray magnetic field; and feedback means being fixedly attached to said sound producing member and moving uniformly therewith and being located along said magnetic field path for sensing the motion of said sound producing member;

wherein said main electromagnetic structure further comrpises an inner pole piece surrounding said feedback means and a second non-megnetic electrically conductive member being interposed in between said inner pole piece and said stray magnetic field; and wherein said magnetic field path traverses or is located along said main electromagnetic structure, said metallic member, said suppressing non-magnetic electrically conductive member, said feedback means, said inner pole piece, and the rest of said main electromagnetic structure.

* * * * *